US005120050A

United States Patent [19]

Fowell

[11] Patent Number: 5,120,050

[45] Date of Patent: Jun. 9, 1992

[54] EXERCISE MACHINES

[75] Inventor: Ian G. G. Fowell, Birmingham, England

[73] Assignee: Sport Engineering Limited, United Kingdom

[21] Appl. No.: 619,110

[22] Filed: Nov. 28, 1990

[30] Foreign Application Priority Data

Dec. 2, 1989 [GB] United Kingdom ..... 8927322

[51] Int. Cl.[5] ..... A63B 23/06

[52] U.S. Cl. ..... 482/52; 272/69

[58] Field of Search ..... 272/69, 70, DIG. 1, 272/DIG. 5, 96, 129

[56] References Cited

U.S. PATENT DOCUMENTS 3,592,466 7/1971 Parsons ..... 272/69

4,927,136 5/1990 Leask ..... 272/69

FOREIGN PATENT DOCUMENTS 2503118 4/1976 Fed. Rep. of Germany ..... 272/69

*Primary Examiner*—Stephen R. Crow

*Attorney, Agent, or Firm*—Learman & McCulloch

[57] ABSTRACT

A step type exerciser (FIG. 3) comprises an endless loop of steps in which each step has an associated pair of pulleys, one (14) at each end, and these run on fixed "inside out" Vee belts (10). This provides a particularly inexpensive guide means which is quiet in running. Drive is transmitted by toothed pinion blocks (18, 22) carried adjacent to each roller but angularly fixed whereas the rollers are rotatable, and the blocks engage a second belt (40) which is driven by a motor (26).

7 Claims, 4 Drawing Sheets

EXERCISE MACHINES

This invention relates to exercise machines of the kind comprising a flight of steps which are arranged so as to be displaced in a downwards direction whilst the user "ascends" them, so that the user stays in approximately the same position. These machines have an endless loop of steps with two (usually) parallel runs, and the steps invert at the bottom of the loop to pass in upside-down position up the rear run and then re-invert as they move down the front run in the effective position.

One such machine is described in U.S. Pat. No. 3,497,215. This has a loop of roller chain at each side to convey the steps. The steps carry rollers at each end which run in an endless guide channel which necessarily follows a different course to the chains in order that the chains can extend in a series of straight lines between successive steps. This is an expensive machine to make and maintain because of the close manufacturing tolerances necessary.

Another machine is shown in U.S. Pat. No. 3,592,466 in which the rollers and channel is avoided by extending the chains about sprockets at each end of the loops, but this fails to take account of the difference in length between the straight line configuration of the chain between adjacent pivotal connections to successive steps, and the length along the curve where the chain extends around the sprockets: and without some other but unexplained mechanism to allow for this, it may be that the arrangement is unworkable.

In U.S. Pat. No. 4,687,195 sprockets are again used, but the steps are made in two parts pivoted together at the junction between each tread and each riser as well as between each riser and the next tread. This allows the parts to pivot as the chains pass around the sprockets. This also is an expensive construction.

A further disadvantage with all of the known arrangements is that the roller chains and sprockets inevitably wear in use and become noisy.

An object of the invention is to solve these problems.

According to the invention a step type exerciser comprises an endless loop of steps each pivoted to the next, a roller provided at each end of each pivot, a guide at each side of the steps for said rollers, and means for driving the loop of steps, and is characterised in that the guide comprises an endless Vee belt fixed around the periphery of a frame member, and in that the rollers are grooved to engage said belt.

Vee belts are made of rubber and like elastomeric materials with various textile and other reinforcements and they are normally used for transmission purposes for example for fan belt drives in vehicle cooling systems; they are readily available in a wide range of sizes at low prices. The frame may be a panel of fibre board or the like which can be accurately sawn within the tolerances required in the present invention. The use of for example grooved metal rollers on the rubber belt gives a particularly quiet operation and allows generous manufacturing tolerances whilst also providing a particularly economical construction. The board may be of a thickness in excess of the width of the Vee belt and may have a slot milled in the edge to locate the Vee belt laterally.

The Vee belt is preferably used "inside out" as compared to the normal way in which a Vee belt is used, that is with flanks converging from the inside of the loop of the belt to the outside of the loop.

Preferably the rollers run on the flat outer face of the belt and preferably with a clearance between the side flanks of the belt and the side flanks of the grooved rollers. A total clearance of the order of 0.3 mm between the side flanks and the side faces is suitable. The angle of the said side flanks may be the same as the Vee belt section.

According to an important feature of the invention, the drive means comprise gear teeth on each pivot, and a toothed driving belt extending in an endless loop having one run adjacent and parallel to an edge of said guide, the arrangement being such that as each set of teeth travels around the guide it engages the said one run to be driven by the toothed belt for the length of said one run. This length is greater than the linear spacing of each two adjacent pivots so that there is always one pivot in driving relation. Preferably there is always two pivots in driving relation. Preferably the driving arrangements are duplicated, that is at each side of the steps.

The pivots comprise shafts which are fixed in angular relationship to the steps and hence are not free to rotate. Hence each set of teeth need not be in the form of a circular pinion, but rather as a rack of teeth complementary to the toothed belt, thus enabling the whole set of teeth to engage with the drive belt at each pivot.

These toothed drive belts are made of the same kind of materials and are used for the same kind of purposes as the Vee belts, although they are often used to drive cam shafts and as timing belts, and similarly are widely available at relatively low prices. Again the toothed belt is to be turned inside out in relation to the most usual usage, so that the teeth extend externally of the loop of belt. Preferably the tooth formation is of the kind comprising parallel flanks normal to a base containing the length of the belt, which ensures good drive relationship and avoids slipping even if the teeth on the belt and those on the pivot are not fully engaged. But preferably engagement is insured by a pressure plate fixed to the frame and on the inside of the drive belt loop adjacent to said rung. The pressure plate is best coated with low friction material such as PTFE.

In usual fashion for these machines the prime mover may be an electric motor in this case driving the toothed belt, and the speed may be variable.

One embodiment of the invention is now more particularly described with reference to the accompanying drawings wherein FIG. 1 is a somewhat diagrammatic and fragmentary perspective view showing the guiding and drive arrangements;

Figure 1:
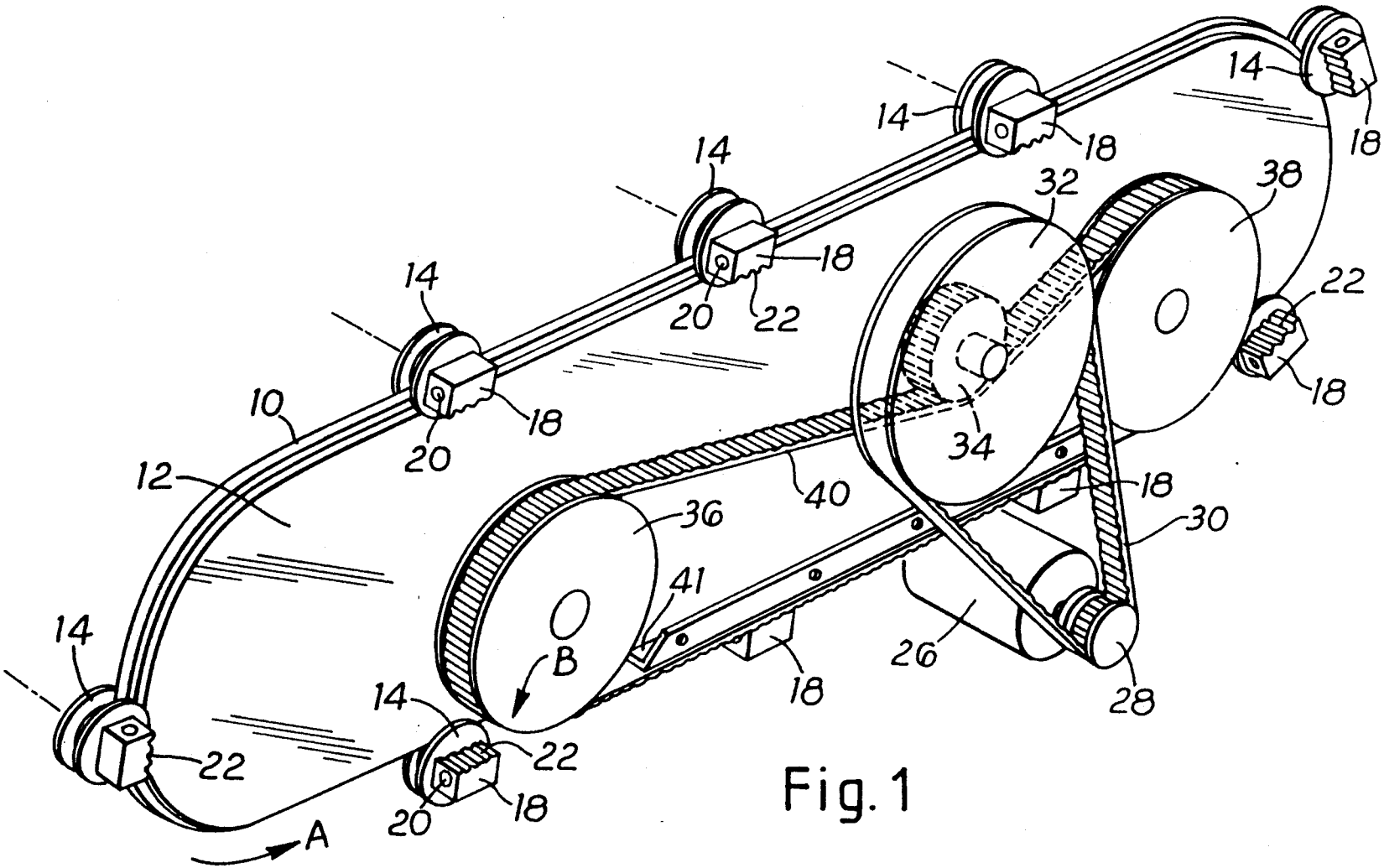
Figure 4:
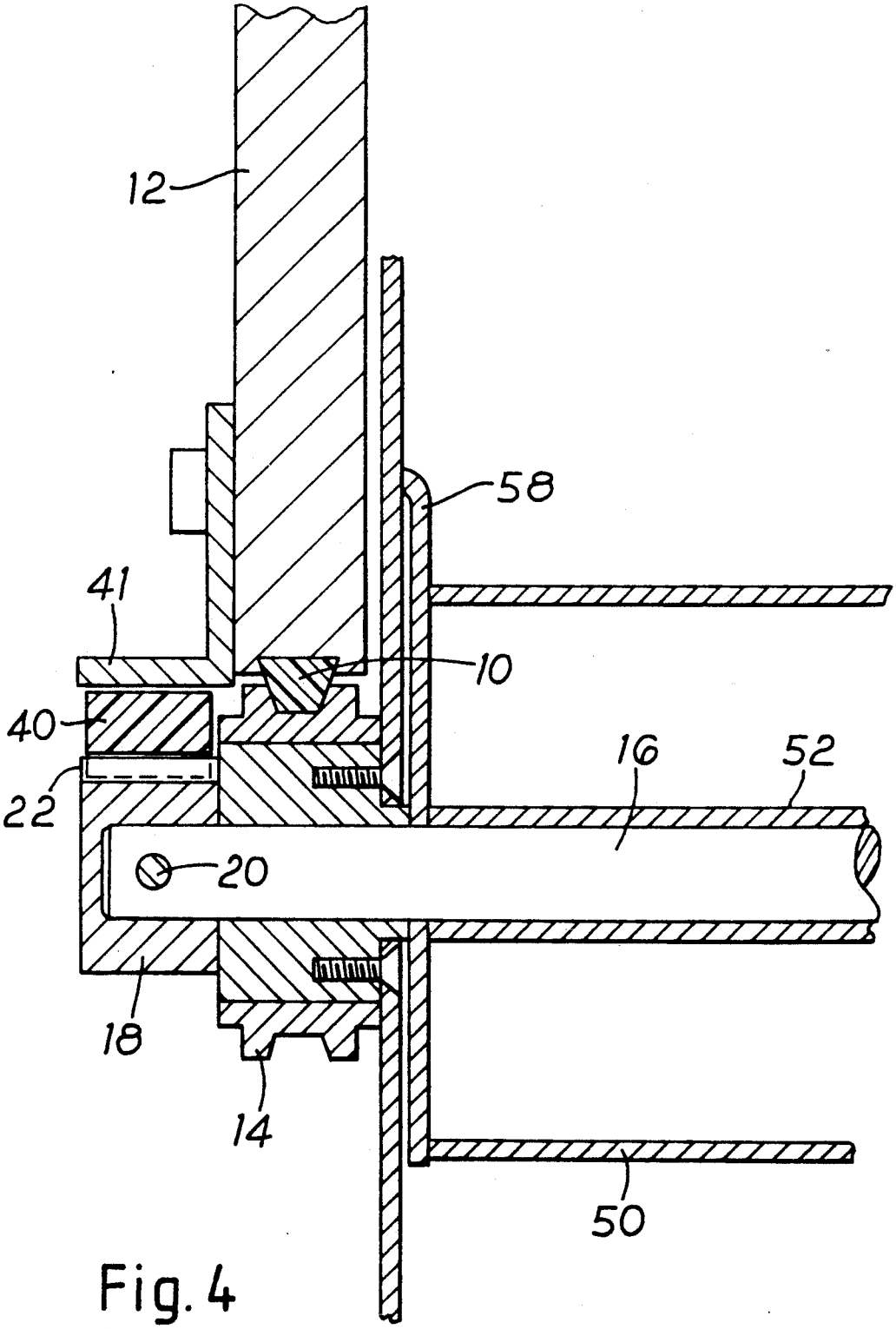
FIG. 4 is a fragmentary sectional view to show the guiding and drive arrangement in more detail.

Turning now first to FIG. 1, the guide track is provided by the Vee belt 10 as mentioned, located on the edge of a panel 12 conveniently sawn to shape from medium density fibre board. The pulleys 14 engage with the Vee belt and roll on it as an endless track in circulating around the periphery of the panel 12, and each pulley 14 is journalled on a bush 15 fixed to the step and carried on an end of shaft 16 (FIG. 4) forming a pivot between two adjacent steps. Outward of the pulley is a "pinion" or rack block 18 held in angular relationship to the shaft by pin 20 so that the rack teeth 22 are always maintained in a fixed relationship inwardly directed towards the centre of the panel 12.

The drive arrangement comprises a motor 26 located at any convenient position within a framework of the exerciser and carrying a (true) pinion 28 meshed with a first toothed belt 30 which in turn meshes with a second and larger toothed pinion 32 fast with a final drive pinion 34. This is to provide an appropriate gear reduction. A pair of plain drive discs 36, 38 are journalled on parallel axes supported by the panel 12 and final drive toothed belt 40 is looped about those discs, this belt being inside out as compared to the belt 30 so that its drive teeth are on the outer side of the loop rather than the inner side of the loop. Belt 40 is in drive relation with final drive pinion 34, and the straight run of this drive belt between the drive discs and close to an edge of the panel 12 forms the drive portion of this belt. That straight portion is backed by a pressure plate 41 fixed to the panel 12, and this pressure plate has a low friction surface.

In use, the pinions are moved in the direction of the arrow A and as each pinion in turn encounters the drive belt in the vicinity of the arrow B its teeth 22 come into drive engagement with the belt and hence it is carried along by the belt.

Figure 3:
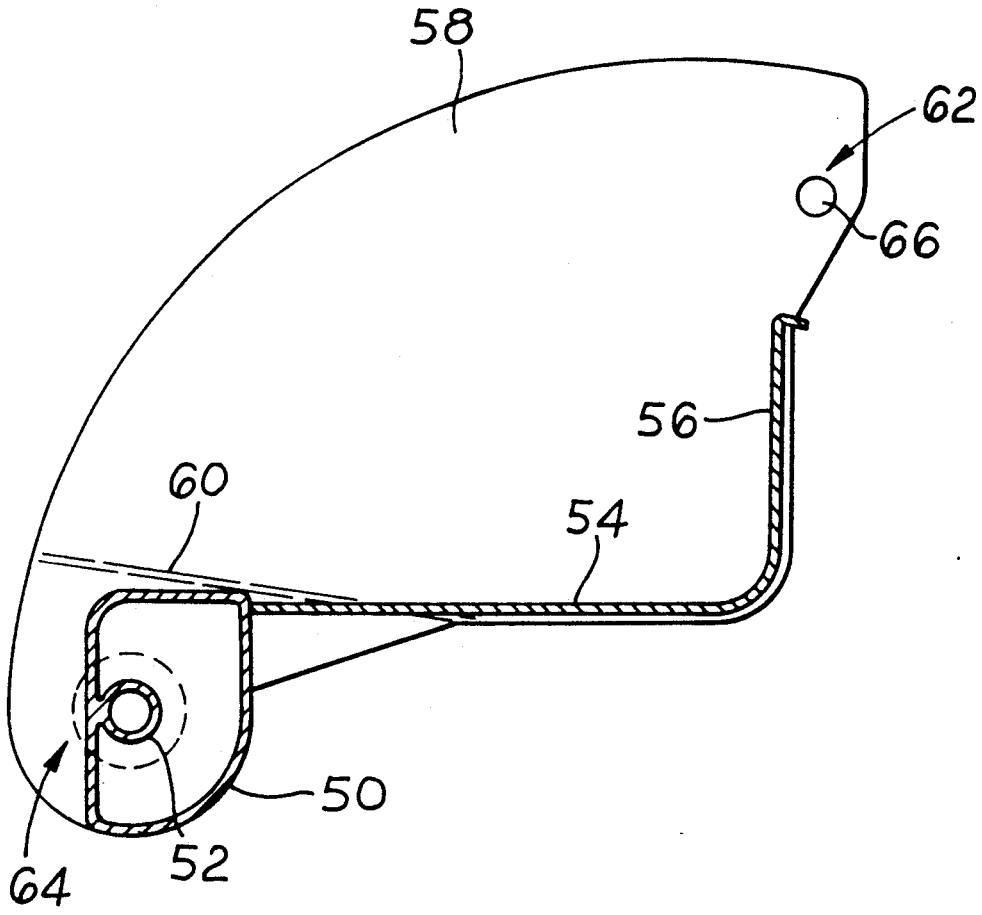
FIG. 3 is a sectional elevation of a single step.

A typical suitable step construction is shown in FIG. 3. This is made of a light alloy extrusion of box section 50 with an integral sleeve 52 to receive the shaft, and the step 54 and riser 56 are made as a one piece construction, conveniently also of a light alloy. The step is completed by a pair of side walls, one at each lateral end, and the whole construction is for example welded together. The side walls 58 are inwardly joggled at 60 so that those in the vicinity of the reference 62, extending above the riser 56 can fit outside the nose of the tread 54 of the next step in the vicinity of the reference 64, and the shaft which extends through the bush 52 of the one extends through the aperture 66 of the other.

Figure 2:
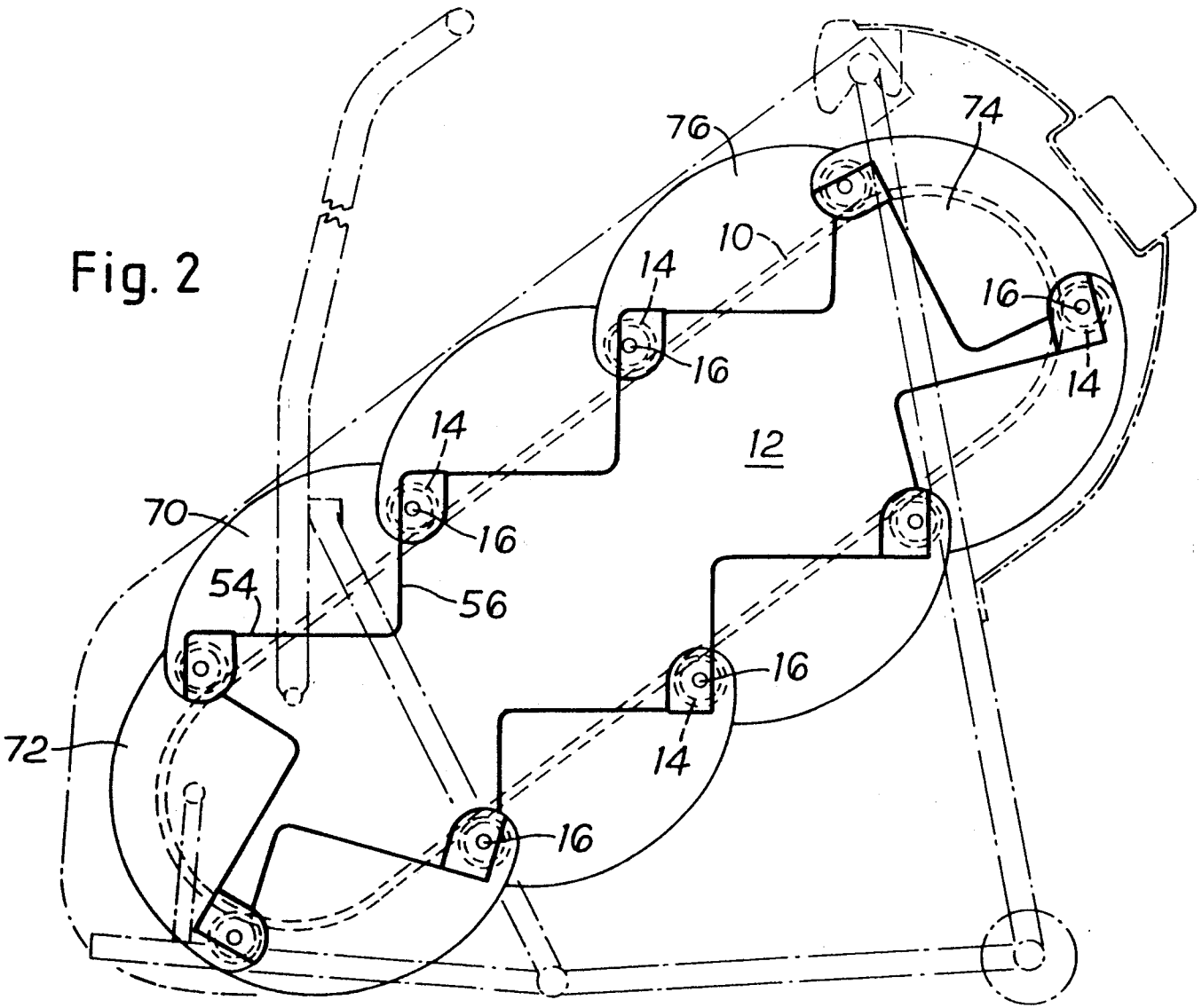
FIG. 2 is a side elevation, also with parts omitted for clarity showing the steps arrangement.

FIG. 2 shows an arrangement with nine steps of which three are in the operative position in the illustration, as the lowermost step 70 passes to the position occupied by the step 72, the step 74 passes to the position of the uppermost step 76 in FIG. 2, and so on.

The exerciser is completed by a suitable frame to maintain the panels 12 at the appropriate inclination, for example so that the treads 54 are horizontal, and with suitable cladding panels to conceal the working parts for aesthetic reasons and safety reasons.

Having now described my invention what I claim is:

1. A step type exerciser comprising an endless loop of steps each pivoted to the next, a roller provided at each end of each pivot, a guide at each side of the steps for said rollers, and drive means for driving the loop of steps, and characterised in that the guide comprises an endless Vee belt fixed around the periphery of a frame member, and in that the rollers are grooved to engage said Vee belt; said drive means comprising gear teeth on each pivot and a toothed driving belt extending in an endless loop having one run adjacent and parallel to an edge of said guide, the arrangement being such that as each set of teeth travels around the guide it engages the said one run to be driven by the tooth belt for the length of said one run.

2. An exerciser as claimed in claim 1 in which the flanks of the Vee belt converge from the inside of the loop to the outside thereof.

3. An exerciser as claimed in claim 2 in which the rollers are of complementary section to the Vee belt and run on the flat surface of the Vee belt, with a clearance between the side flanks of the Vee belt and the side flanks of the rollers.

4. An exerciser as claimed in claim 1 wherein at least two pivots are always in driving relation.

5. An exerciser as claimed in claim 1 wherein the driving arrangements are duplicated and are at each side of the steps.

6. An exerciser as claimed in claim 1 wherein the teeth of the driving belt are on the outside of the driving belt and comprise parallel flanks normal to a base.

7. An exerciser as claimed in claim 6 wherein a pressure plate coated with low friction material is located on the inside of the drive belt.

* * * * *